United States Patent [19]

Montalbano

[11] Patent Number: 4,692,122

[45] Date of Patent: Sep. 8, 1987

[54] ELECTRICAL TERMINAL

[75] Inventor: Peter Montalbano, St. Paul, Minn.

[73] Assignee: Minnesota Mining and Manufacturing Company, St. Paul, Minn.

[21] Appl. No.: 915,416

[22] Filed: Oct. 6, 1986

[51] Int. Cl.[4] ..... H01R 4/18

[52] U.S. Cl. ..... 439/882; 29/863

[58] Field of Search ..... 339/276 R, 276 SF, 276 T, 339/276 F; 29/863

[56] References Cited

U.S. PATENT DOCUMENTS

| | | | |
|---|---|---|---|
| 450,589 | 4/1891 | Marsh | 174/135 |
| 2,283,918 | 5/1942 | Dekome | 29/149.5 |
| 2,293,491 | 8/1942 | Cox | 85/40 |
| 2,762,117 | 9/1956 | Houck | 29/521 |
| 3,001,169 | 9/1961 | Blonder | 339/177 |
| 3,051,773 | 8/1962 | Batcheller | 174/94 |
| 3,099,238 | 7/1963 | Jones | 113/120 |
| 3,200,367 | 8/1965 | Blanchenot | 339/198 |
| 3,234,321 | 2/1966 | Logan et al. | 174/75 |
| 3,404,368 | 10/1968 | Roberts et al. | 339/223 |
| 3,594,713 | 7/1971 | Thoman | 339/223 |
| 3,597,723 | 8/1971 | Schmidt | 339/26 |
| 3,648,224 | 3/1972 | McDonough | 339/276 T X |
| 3,699,504 | 10/1972 | Huber | 339/276 T X |
| 4,142,771 | 3/1979 | Barnes et al. | 339/95 |
| 4,400,050 | 8/1983 | Hayward | 339/177 |
| 4,415,223 | 11/1983 | Asick | 339/276 |

*Primary Examiner*—Eugene F. Desmond

*Attorney, Agent, or Firm*—Donald M. Sell; James A. Smith; Terryl K. Qualey

[57] ABSTRACT

An electrical conductor interconnection terminal with a double wall barrel joined across a seam therein.

11 Claims, 6 Drawing Figures

ELECTRICAL TERMINAL

BACKGROUND OF THE INVENTION

1. Field of the Invention

The present invention relates to terminals for provision on ends of elongated electrical conductors such as insulated wires and, more particularly, to terminals which are crimped against such wires thereby avoiding the use of any bonding material.

Many kinds of conductor end terminals are available for use in providing terminal means for making mechanical and electrical connections of the corresponding electrical conductor, such as an insulated wire, where the connection between the conductor and terminal is made by crimping. Many of these terminals employ one or more metal barrels, or tube sections, into at least one of which the uninsulated end of such a conductor is placed. Thereafter, the tube is crimped against that uninsulated end. Such a crimp secures both an electrical connection and a mechanical connection between the terminal and the wire. As a result, use of solder or other bonding material between the terminal and the wire can be avoided to reduce time for assembly and the cost thereof. Often, serrations or protuberances directed from the tube section inner surface into the passageway are present to provide additional aid in securing a good mechanical connection.

There are competing considerations in choosing the metal to be used in forming such a terminal. A connecting portion for making contact with other objects usually can be of a relatively small gauge where used, as is typical, just for purposes of making contact with other terminals, other kinds of connectors or the like. However, the ability of the barrel, or tube section, to make a good crimp for providing an interconnection of substantial mechanical strength depends, to a significant degree, on the thickness (or gauge if a single sheet) of the metal used in forming the tube section wall.

Increasing the thickness of the tube section wall relative to the thickness of the connecting portion is expensive if two different gauges of metal are to be joined. This can be overcome by the use of a folded-over portion of a thinner gauge metal used for both the connecting portion and the tube section portion, such as is shown in U.S. Pat. No. 4,142,771 to Barnes et al. Shown there is a barrel or tube section constructed of two tabs of metal, each having serrations therein, and each of which is folded toward the other against the metal joining them to form the barrel of the terminal. Thus, a thicker tube section wall is obtained than could be obtained from just a single sheet of metal of the same thickness.

Another method for obtaining a thicker wall is to use a metal sleeve over a single sheet thick metal barrel, as shown in U.S. Pat. No. 3,594,713 to Thoman. This shows a serrated barrel with a sleeve thereover which provides a double wall barrel. The sleeve has an end portion folded over against itself to achieve a mechanical connection with the wire.

Another difficulty in maintaining a good mechanical connection is the tendency of a barrel with seams to spread apart at those seams when tension is placed between the terminal and the wire crimped thereon. This spreading of the seams tends to cause a loosening of the grip of the crimped portion at the terminal to the wire which can lead to a mechanical connection failure. The occurrence of more than one seam in the barrel, such as because a seam caused by folding portions of a sheet toward one another in making a double wall, tends to aggravate this problem. One means of providing a stronger seam is by the use of a locking tab such as is shown in U.S. Pat. Nos. 3,051,773 to Batcheller and 3,404,368 to Roberts et al.

Thus, an electrical terminal with a strong barrel or tube section wall and having no more than one seam would be desirable. Such a barrel would be further enhanced by means to prevent the seam from spreading during use.

SUMMARY OF THE INVENTION

The present invention provides an electrical conductor interconnection terminal having a barrel or tube section which is formed from a folded first portion of a sheet of material, folded toward the terminal connection portion to provide the inner surface of the tube. This first portion can be provided with protuberances projecting into the tube passageway. The outer tube surface formed by the portion against which the first portion is folded, has a protuberance from one side thereof positioned in an opening in the other side thereof to prevent the seam formed by these two sides of these two portions from spreading.

Such a terminal is formed from a sheet of material serving as a blank, having a connection portion and a crimping portion, by folding a first part of the crimping portion against a second part as a basis for the crimping portion thereafter forming a double walled tube portion. The tube portion is then formed with the second part having a protuberance therefrom fitting into a second opening therein.

DETAILED DESCRIPTION OF THE PREFERRED EMBODIMENTS

Figure 1:
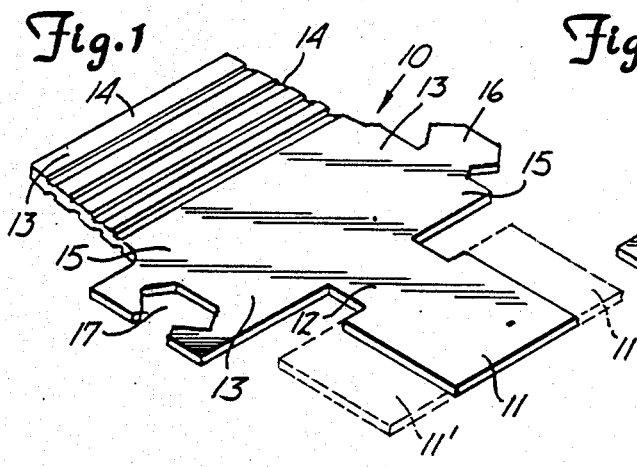
FIG. 1 shows a sheet of metal serving as a blank for the terminal of the present invention.

FIG. 1 shows a sheet of metal which has been cut to a desired shape to form a blank; 10, the entire cut typically being formed at once by well known stamping methods. The sheet of metal or blank 10 has a connection portion, 11, which is shown in FIG. 1 as generally to the right of a narrow neck portion, 12. A tube portion or crimping portion, 13, is shown generally to the left of narrow neck region 12.

Connecting portion 11 is shown in solid lines in a rather narrow form suitable for use as a spade in a spade interconnection arrangement with another electrical conductor interconnection terminal. A widened connecting section, 11', is indicated where a more extensive structure is desired for the connecting portion in the final terminal configuration. Many other kinds of connecting portions for the terminal could be formed beyond what has been shown in FIG. 1, another common one being a ring to permit having the connecting portion provided over a threaded stud under a nut or to be secured by a screw.

Crimping portion 13 is the portion which is used to form the barrel or tube section portion of the completed electrical conductor interconnection terminal. Crimping section 13 has a first part, 14, which has serrations or protuberances which will appear in the interior of the tube section of the completed terminal. The second part, 15, of crimping portion 13 is free of such serrations but has a protuberance, 16, extending outward from one side thereof and a complementary opening, 17, provided inward from the opposite side thereof. Opening 17 is formed to complement the outline of protuberance 16 such that protuberance 16 can be positioned in this opening, as will be set forth below. First part 14 of crimping portion 13 narrows at points correspondingly further removed from second part 15 to aid in the forming of the tube section to result therefrom.

The sheet of metal, or blank, 10 can be provided from a wide range of materials and over a substantial range of thicknesses. The thickness chosen will depend primarily on the size of the barrel to be constructed and the intended diameter of the wires to be crimped therein. For common kinds of metal used, the range of thicknesses is typically between 0.016 and 0.040 inches. The commonly used metals for such a terminal would be cartridge brass or an electrolytic tough pitch alloy of copper. Specific metal examples, following the standards of the Copper Development Association, would be CDA-260 for cartridge brass and CDA-110 for the copper alloy.

Figure 2:
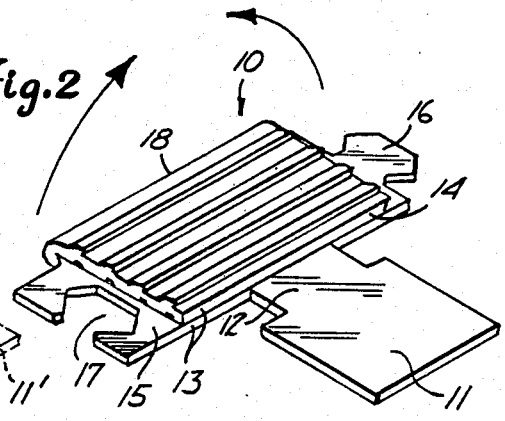
FIG. 2 shows the result of folding a portion of the blank to form a double wall.

FIG. 2 shows the result of folding first part 14 of crimping region 13 against second part 15 of crimping region 13. As a result of the folding, a fold junction or fold region, 18, occurs between first part 14 and second part 15 which extends between the opposite sides of crimping region 13.

Figure 3:
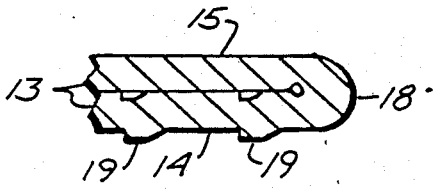
FIG. 3 shows a cross section of the fold junction and nearby serrations.

A cross section view of fold juncture 18 is shown in FIG. 3. There can be seen the resulting double wall with a set of serrations or protuberances, 19, formed on one side of the wall. Fold juncture 18 can be seen joining the two wall portions formed of first part 14 and second part 15.

Figure 4:
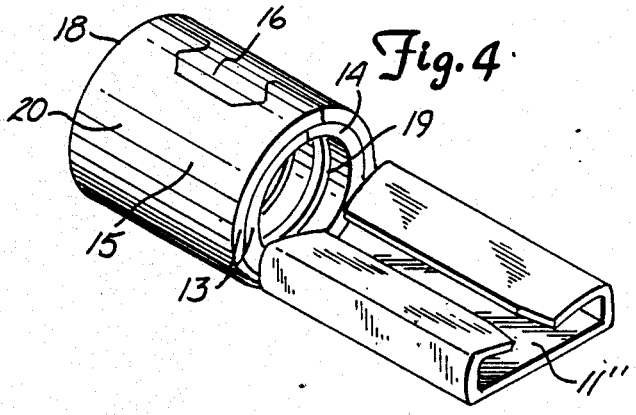
FIG. 4 shows a view of the terminal after the double wall has been formed into a tube.

The arrows in FIG. 2 indicate how the now folded crimping portion is to be formed to result in a double-walled tube section, 20, or barrel, shown in FIG. 4. Crimping portion 13 has its opposite sides brought around toward one another so that each side, at least in part, abuts the other to form a single seam. Thereafter, protuberance 16 is mated with opening 17 to hold that seam securely closed against mating protuberance 16 being pulled out of opening 17. This occurs because a dimension across mating protuberance 16, more or less parallel to one side of crimping portion 13, or more particularly to one side of second part 15, is greater in extent than a dimension in the same direction across some portion of opening 17 which is located closer to the side of second part 15 from which opening 17 extends.

Juncture region 18, as a result of the forming of tube section 20, forms a closed path around the end of tube section 20 opposite the end closest to the connecting portion except at the seam between the opposite sides of crimping region 13, thereby forming a smooth entrance to the passageway within tube section 20. Note that protuberances 19 now extend from what has become the interior wall of tube section 20 to project into the passageway therein. Also, connecting portion 11' has been chosen from FIG. 1 to show a formed connecting portion 11'' in FIG. 4. Again, many kinds of connecting portion structures could be alternatively provided.

Figure 5:
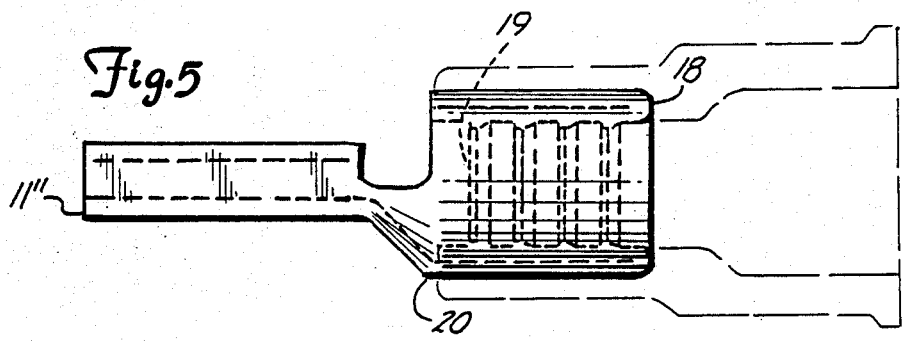
FIG. 5 shows another view of the completed terminal.

A side view of the electrical conductor interconnection terminal of FIG. 4 is shown in FIG. 5 with short dashed lines to show the hidden interior structure. Further shown in FIG. 5, in long dashed lines, is a possible insulator to be provided over the double wall of tube section 20. The interior short dashed lines make clear the protrusions 19 projected into the passageway through tube section 20, and the double wall of tube section 20 formed by first part 14 being folded against second part 15 of crimping section 13.

Figure 6:
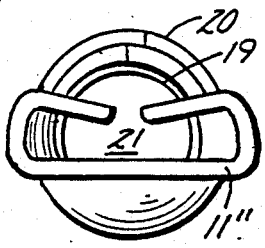
FIG. 6 shows another view of the completed terminal.

FIG. 6 shows an end view of the terminal looking from connection portion 11'' to tube section 20 beyond. Protrusion 19 into the earlier mentioned interior passageway, 21, can be seen directly.

The completed electrical conductor interconnection terminal can be seen to have but one seam at which any spreading could occur because the folding of first part 14 against second part 15 of crimping section 13 is in a direction toward connection portion 11''. Beyond that, however, the spreading is essentially prevented by positioning mating protrusion 16 in opening 17, an arrangement achieved even though mating protrusion 16 is of a single sheet thickness while the walls of tube section 20 it is securing are of a double sheet thickness to give a much improved crimp against a wire provided in passageway 21. In assembling the completed terminal and a wire, the crimp is typically made across mating protuberance 16.

Although the present invention has been described with reference to preferred embodiments, workers skilled in the art will recognize that changes may be made in form and detail without departing from the spirit and scope of the invention.

What is claimed is:

1. An electrical interconnection terminal having a connector portion usable for being in contact with other objects, and having a tubular portion with a wall means surrounding a passageway in which an extended interconnection member can be accepted and secured by said wall means being crimped thereagainst, said wall means having a first portion of a sheet of material folded toward said connection portion and against a second portion of said sheet of material such that said first portion forms an interior surface about said passageway with that junction region resulting between said first and second portions extending between opposite sides of said sheet of material, said second portion having an opening at one said side thereof in which is positioned a mating protuberance extending from said opposite side thereof.

2. The terminal of claim 1 wherein said mating protuberance is held in said opening by said second portion against pulling said mating protuberance in a direction away from said opening.

3. The terminal of claim 1 wherein said first portion extends from said junction region of said first and second portions past said opening in said second portion.

4. The terminal of claim 1 wherein said first portion has at least one crimping protuberance projecting therefrom toward said passageway.

5. An electrical interconnection terminal having a connection portion usable for contact with other objects, and having a tubular portion with a wall means surrounding a passageway in which an interconnection member can be accepted and secured by said wall means being crimped thereagainst, said wall means formed by a single sheet of material folded over against itself at a fold junction to provide an inner sheet portion and an outer sheet portion with said fold junction forming a closed path about an end of said passageway opposite that end of said passageway nearest said connection portion except for a seam formed by opposite sides of said sheet between which said fold junction terminates with said opposite sides abutting one another, said inner sheet forming an interior surface of said wall means, said outer sheet forming an outer surface of said wall means and having an indentation therein along one side of said seam and having a mating protuberance along the other side of said seam which is positioned in said indentation.

6. The terminal of claim 5 wherein said indentation and said mating protuberance have mating portions with a dimension thereacross in a direction parallel to said seam which is greater than a dimension across said mating protuberance and indentation at a position closer to said seam.

7. The terminal of claim 5 wherein said inner sheet extends from said fold junction past said indentation.

8. The terminal of claim 5 wherein said inner sheet has at least one crimping protuberance projecting therefrom toward said passageway.

9. A method for forming an electrical interconnection terminal, said method comprising:

providing an initial blank as a sheet of material having a connection portion and a crimping portion at opposite ends of said sheet of material;

folding a first part of said crimping portion toward said connection portion and against a second part of said crimping portion so that a junction region between said first part and said second part extends between opposite sides of said sheet of material in said crimping part with said second part of said crimping portion having an opening provided on one of said sides thereof and a mating protuberance extending from said opposite side thereof; and forming said crimping portion into a tube with said first part forming an interior surface of said tube and said second part forming an exterior surface of said tube with said mating protuberance positioned in said opening.

10. The method of claim 9 wherein said providng of said initial blank includes providing at least one crimping protuberance into said first part of said crimping portion.

11. The method of claim 10 wherein said providing of said initial blank includes having said first part being more narrowed at locations correspondingly farther away from said junction region.

* * * * *